US006716031B2

(12) United States Patent
Wood et al.

(10) Patent No.: US 6,716,031 B2
(45) Date of Patent: Apr. 6, 2004

(54) INTERACTIVE LEARNING APPARATUS RESPONSIVE TO STRIKING

(75) Inventors: Michael C. Wood, Orinda, CA (US); Jorge Garbriel Soto, Concord, CA (US)

(73) Assignee: LeapFrog Enterprises, Inc., Emeryville, CA (US)

( * ) Notice: Subject to any disclaimer, the term of this patent is extended or adjusted under 35 U.S.C. 154(b) by 52 days.

(21) Appl. No.: 10/020,570

(22) Filed: Dec. 7, 2001

(65) Prior Publication Data

US 2002/0197931 A1 Dec. 26, 2002

Related U.S. Application Data

(60) Provisional application No. 60/299,830, filed on Jun. 20, 2001.

(51) Int. Cl.[7] ..... G09B 1/00

(52) U.S. Cl. ..... 434/159; 434/169; 434/393; 446/418; 446/175; 84/420; 84/470 R

(58) Field of Search ..... 434/167, 335, 434/393, 159, 161, 169, 176, 201, 258, 308, 309; 446/175, 297, 397, 402, 403, 418, 420, 484; 273/454; 40/446, 465, 463; 84/420, 411 R, 470 R, 477 R, 478, 479 R, 485 R

(56) References Cited

U.S. PATENT DOCUMENTS

| | | | | |
|---|---|---|---|---|
| 4,390,181 | A | | 6/1983 | Parish |
| 4,830,369 | A | | 5/1989 | Poitras |
| 4,875,675 | A | | 10/1989 | Arad et al. |
| 5,055,053 | A | * | 10/1991 | Hyman ..... 434/343 |
| 5,288,069 | A | | 2/1994 | Matsumoto |
| 5,390,927 | A | | 2/1995 | Angelos |
| 5,419,549 | A | | 5/1995 | Galloway et al. |
| 5,478,240 | A | * | 12/1995 | Cogliano ..... 434/327 |
| 5,500,635 | A | | 3/1996 | Mott |
| 5,540,608 | A | | 7/1996 | Goldfarb |
| 5,566,934 | A | | 10/1996 | Black et al. |
| 5,573,239 | A | | 11/1996 | Ryker et al. |
| 5,587,545 | A | | 12/1996 | Nakada et al. |
| 5,697,791 | A | | 12/1997 | Nashner et al. |
| 5,743,744 | A | | 4/1998 | Cassily et al. |
| 5,813,861 | A | | 9/1998 | Wood |
| 5,971,761 | A | | 10/1999 | Tillman, Sr. |
| 6,068,484 | A | | 5/2000 | O'Loughlin et al. |
| 6,074,212 | A | | 6/2000 | Cogliano |
| 6,129,016 | A | | 10/2000 | Rehkemper et al. |
| 6,150,594 | A | | 11/2000 | Fiondella et al. |
| 6,220,916 | B1 | | 4/2001 | Bart et al. |
| 6,238,217 | B1 | * | 5/2001 | Mirando et al. ..... 434/365 |

OTHER PUBLICATIONS

Electronic Simon Says. www.Amazon. com. Nov. 2001.*

* cited by examiner

*Primary Examiner*—Jacob K. Ackun
*Assistant Examiner*—Bena B. Miller
(74) *Attorney, Agent, or Firm*—Townsend and Townsend and Crew LLP

(57) ABSTRACT

An interactive learning apparatus is disclosed. In one embodiments, the interactive learning apparatus comprises: (a) a housing; (b) an impact sensor unit in the housing; (c) a processor and memory unit operatively coupled to the impact sensor unit; (d) a display unit operatively coupled to the processor and memory unit; and (e) an audio output unit operatively coupled to the processor and memory unit, wherein the display unit is adapted to display an image in response to the user striking a portion of the housing.

28 Claims, 5 Drawing Sheets

INTERACTIVE LEARNING APPARATUS RESPONSIVE TO STRIKING

CROSS-REFERENCES TO RELATED APPLICATIONS

This application claims priority from U.S. provisional application No. 60/299,830, filed Jun. 20, 2001, which is hereby incorporated in its entirety by reference for all purposes.

BACKGROUND OF THE INVENTION

1. Field of the Invention

The present invention relates to a learning apparatus.

2. Description of the Related Art

Conventional learning apparatuses (e.g., educational toys) for young children are typically limited with respect to the breadth of curriculum that they teach. A conventional learning apparatus often strives to teach only one thing, such as cause-and-effect, musical awareness or indicia recognition. In other words, the conventional learning apparatus may be limited to a single operating mode and, therefore, a single curriculum. Conventional learning apparatuses may also be focused solely on the teaching of a predetermined curriculum and, therefore, fail to adequately stimulate, engage and entertain a young child (i.e., children six months of age and older). This drawback can be especially pronounced when a young child is an infant with limited motor skills.

Still needed in the field, therefore, is a learning apparatus that is suitable for teaching multiple curricula, including but not limited to cause-and-effect awareness, musical awareness and indicia recognition to children. In addition, the learning apparatus should provide an entertaining and engaging learning experience.

Moreover, many conventional electronic toys simply respond after a user presses buttons. This may be the only mode of interaction that the user has with an electronic toy. It would be desirable to provide new and different ways in which a user can interact with an electronic toy so that the electronic toy engages the user in a manner that is more fun than conventional electronic toys. Furthermore, young children such as infants may not have the motor skills to be able to press the button of an electronic toy. Thus, infants in particular have few educational toys that they can interact with.

Embodiments of the invention address these and other problems.

SUMMARY OF THE INVENTION

Embodiments of the invention are directed to interactive learning apparatuses.

In one embodiment, the interactive learning apparatus comprises: (a) a housing; (b) an impact sensor unit in the housing; (c) a processor and memory unit operatively coupled to the impact sensor unit; (d) a display unit operatively coupled to the processor and memory unit; and (e) an audio output unit operatively coupled to the processor and memory unit, wherein the display unit is adapted to display an image in response to the user striking a portion of the housing.

In another embodiment, the interactive learning apparatus comprises: (a) a housing, wherein the housing includes a translucent upper portion and a body; (b) an impact sensor unit in the housing; (c) a processor and memory unit operatively coupled to the impact sensor unit; (d) a display unit operatively coupled to the processor and memory unit and disposed under the translucent upper portion; and (e) an audio output unit operatively coupled to the processor and memory unit, wherein the display unit is adapted to display an image of a letter or an image of an indicium through the upper portion in response to the user striking the translucent upper portion of the housing and wherein the audio output unit is adapted to provide audio information relating to the displayed indicium to the user, and wherein the interactive learning apparatus is in the form of a drum.

These and other embodiments of the invention are described in further detail below with reference to the following detailed description and drawings.

DETAILED DESCRIPTION

Figure 1:
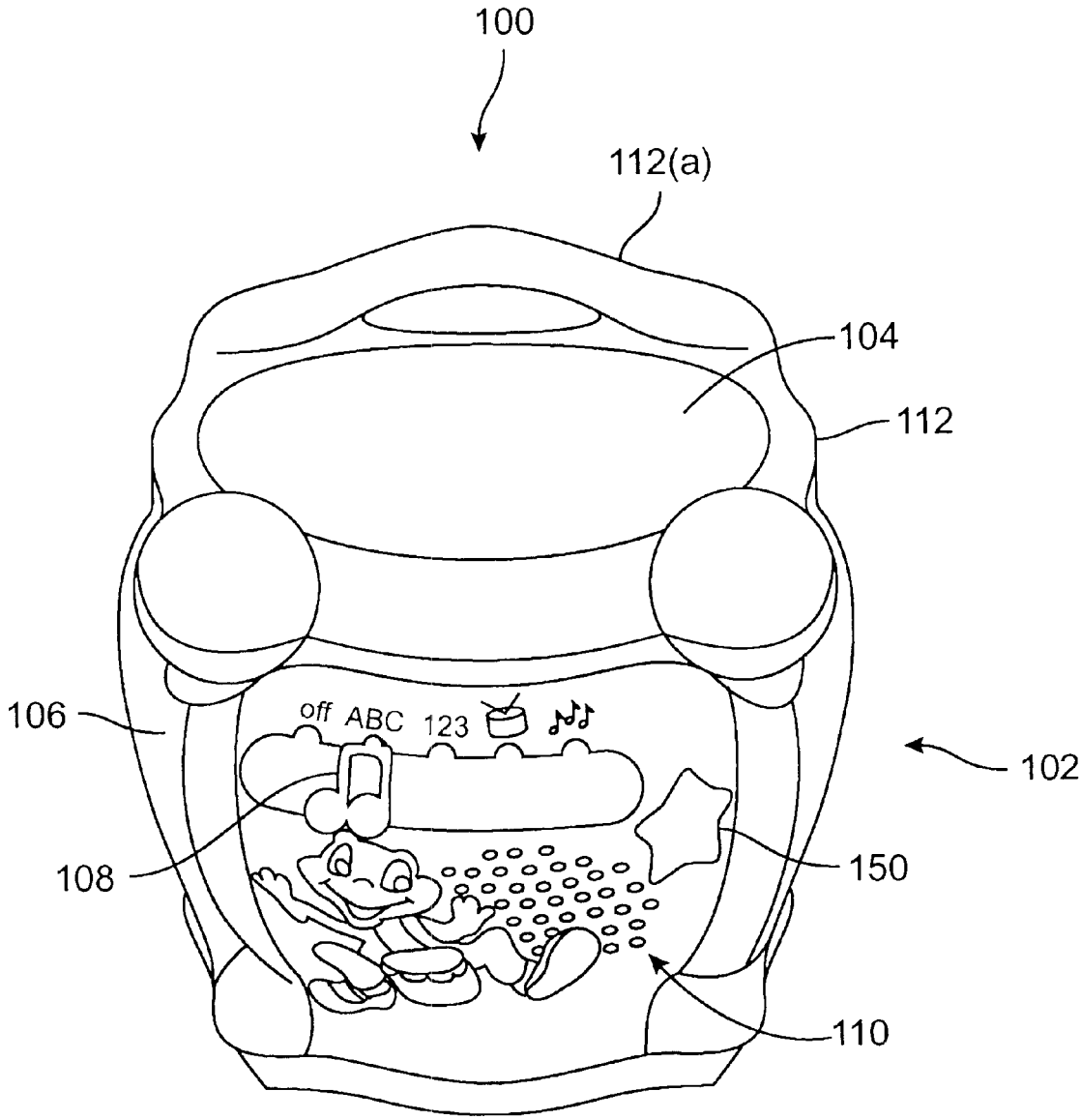
FIG. 1 is a front view of an interactive learning apparatus according to one exemplary embodiment of the present invention. The apparatus is in the form of a drum.

Interactive learning apparatuses in accordance with embodiments of the invention are suitable for teaching young children multiple curricula, such as cause-and-effect relationships, musical awareness, and indicia (e.g., letters and numbers) recognition skills. Such interactive learning apparatuses not only provide a learning experience for the user, but also have entertainment value for the user.

An interactive learning apparatus according to one exemplary embodiment of the invention includes a housing (e.g., a drum-shaped housing) and a sensor unit in the housing. The sensor unit can sense when a user strikes a portion of the housing. Preferably, the interactive learning apparatus is in the form of an object that is ordinary struck by a person. In some embodiments, the interactive learning apparatus is in the form of a drum that invites a child to strike the drum with the child's hands or drumsticks. The interactive learning apparatus can thus be in a form that attracts a user such as a child, independent of the electronic function of the interactive learning apparatus. For example, unlike many conventional electronic toys, a child can play with embodiments of the invention, even though it is turned off.

The interactive learning apparatus also includes a processor and memory unit, a display unit and an audio output unit. The processor and memory unit is cooperatively coupled to each of the sensor unit, display unit and the audio output unit. The display unit can display images such as images of indicia (e.g., letters or numbers) directly after a user strikes a portion of the housing. In embodiments of the invention, many different types of images including letters (e.g., the letters A through Z), phonemes, numbers (e.g., the numbers 1 through 10), symbols (e.g., star, square, circle, triangle), pictures (e.g., pictures of animals), words, etc. can be displayed to the user after the user strikes the apparatus. The image may be a single color (e.g., red) or may be multicolored.

Additionally or alternatively, audio output unit that relates to the displayed image can be presented to the user. In some embodiments, audio output may be presented to the user substantially concurrently with a displayed image. For example, the image may be an image of the letter A, and the sound that comes from the interactive learning apparatus may relate to the sound of the letter A, the identify of the letter A, or the use of the letter A (e.g., a word that starts with the letter A) may be stated.

In the apparatus, the processor and memory unit are configured to implement a plurality of operating modes designed to teach different curricula in an engaging and entertaining manner. For example, the interactive learning apparatus according to one embodiment of the invention can teach young children cause-and-effect, the 26 letters of the alphabet, and numbers (e.g., the numbers from one to ten) using at least two different operating modes. In one operating mode, referred to as "ABCs mode," the letters of the alphabet are sequentially displayed to the user and audibly identified in response to impacts on the housing. The impacts can be caused by the user striking of the housing many times as a child would do with a drum. For example, the user may strike the apparatus 26 times and the letters A to Z may respectively appear. In another operating mode, referred to as "123s mode," the numbers from one to ten are sequentially displayed to the user and audibly identified in response to striking of the housing multiple times. The ABCs and 123s modes teach young children cause-and-effect since the indicia are not displayed or audibly identified unless the housing is struck. In addition, by declaring the ABCs and 123s, the user learns about letter and number recognition, and optionally, letter and number usage and letter pronunciation.

In yet two other operating modes, referred to as the "Follow-the-Beat mode" and "Interactive Song mode," the interactive learning apparatus can teach young children musical awareness. In the "Follow-the-Beat mode," predetermined images are displayed to the user along with associated audible musical beat patterns that may be played in a discontinuous manner. The images may be indicia (e.g., letters, numbers, symbols) or even random patterns that are visually pleasing. Sometimes, displaying random, but visually pleasing patterns after the user strikes the apparatus can keep a young child engaged, since the image that is produced in response to striking is not expected by the child. The young child can learn that, by striking the apparatus, a different, visually pleasing image will be produced and the child will be encouraged to use the apparatus. In any event, a young child is encouraged to follow the pattern by striking the interactive learning apparatus in the same rhythm as the pattern that is initiated by the interactive learning apparatus. In the "Interactive Song mode," the young child plays music in a discontinuous manner that encourages imitation. For example, a song such as the ABC song may play and then stop. After stopping, a gap in the music is provided whereby the user may strike the apparatus in a desired manner. After striking, the song may continue where it left off. Further detail regarding these and other modes are provided below.

The interactive learning apparatuses are especially beneficial for children with limited motor skills since a striking motion against the housing (i.e., hitting of the housing) is within the capability of, and comes naturally to, children as young as six months. Infants (or toddlers), for example, have limited motor skills. A typical infant does not have the motor skills to select small buttons that are on many conventional electronic educational toys. Consequently, it is difficult for an infant to benefit from the conventional educational toys. However, in embodiments of the invention, images can be produced after an infant strikes a "striking zone" in the apparatus. The striking zone may be a portion of the housing that is relatively large and can be struck by the infant. In response, the interactive learning apparatus can provide appropriate output, even for an infant. Thus, the infant can interact with the apparatus, even though the infant's motor skills have not fully developed.

Embodiments of the invention are truly multi-functional. For example, in some embodiments of the invention, a user can cause the interactive learning apparatus to selectively (i) display a sequence of indicia on the housing in response to striking of the housing, (ii) display predetermined indicia patterns along with an associated audible musical beat pattern in a discontinuous manner that encourages pattern following, and (iii) play music in a discontinuous manner that encourages imitation.

Referring to FIG. 1, exemplary interactive learning apparatus 100 includes a housing 102 with an upper portion 104 with an upper surface, a rim 112, and a body 106. The body 106 can be a hollow enclosure (e.g., a barrel-shaped enclosure) with an open end that houses the electronic components of the interactive learning apparatus 100. A handle 112(*a*) may be formed in the rim 112 to allow a user to carry the interactive learning apparatus 100. Preferably, the handle is sized so that toddler can easily grasp and carry the interactive learning apparatus 100. Although in this particular embodiment, housing 102 is drum-shaped and upper portion 104 is therefore configured as the circular "head" of the drum, the housing can take other shapes (e.g., shapes of percussive musical instruments other than a drum) and the upper portion can be configured accordingly. In some embodiments, the upper portion 104 of the housing can be separated from the body 106 by detaching (e.g., unscrewing) the rim 112 from the body 106. In this regard, the rim 112 can be used to secure the upper portion 104 to the body 106 to close an open end of the body 106.

In the illustrated embodiment, the upper portion 104 include a smooth and continuous upper surface, and may also be translucent or transparent. In some embodiments, the upper portion 104 may be a plastic layer that is tensioned so that it is spaced from an impact sensor (e.g., a piezoelectric sensor) under the upper portion 104. When the user strikes the upper portion 104, it flexes until it contacts the impact sensor, thus indicating to a processor (not shown) in the apparatus that the apparatus has been struck.

Figure 2:
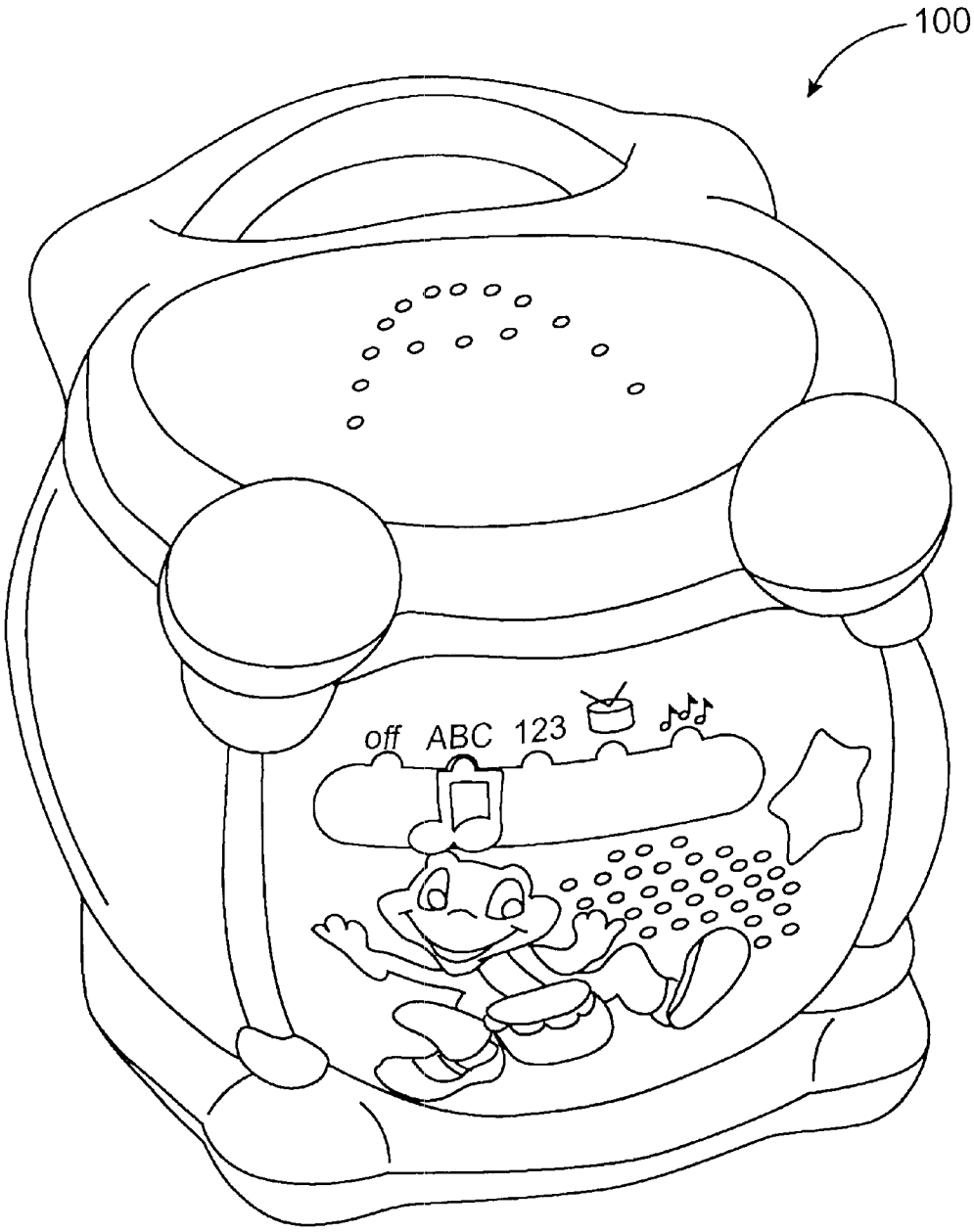
FIG. 2 shows another interactive learning apparatus embodiment. In this embodiment, the letter "A" is shown on the top surface of the housing.

A display unit may be disposed under the upper portion 104 and light from the display unit can pass through the upper portion 104 so that an image can be displayed to the user through the upper portion 104. For example, with reference to FIG. 2, in some embodiments, after striking the upper portion 102, appropriate LEDs in an array of LEDs under the upper portion 104 can light up to form the letter A. The upper portion can be struck again, and selective LEDs in the same array of LEDs may light up to form the letter B. By having the display unit under the upper portion 104 and in the striking zone of the interactive learning apparatus, the image can be displayed where the user strikes the housing and the user can, in a sense, interact with the image. Thus, the image that is displayed to the user can be displayed in the area where the user is striking the interactive apparatus. Because the user is interacting with the image, the user is likely to remember the image and any information conveyed by the image.

In other embodiments, the display unit may be at a different location than the striking zone. For instance, the display unit can be an LCD (liquid crystal display) screen that is to the side of the upper portion 104. Images can be displayed on the LCD screen in response to the user's striking.

The housing 102 can have any suitable dimensions. For example, in some embodiments, the housing can have a diameter of about 5.5 inches and a height of about 5.5 inches. The housing 102 may also be formed from any suitable material and may have any suitable number of parts. Suitable materials include plastic. Interactive learning apparatus 100 can be powered using batteries (not shown) stored within housing 102. The interactive learning apparatus 100 may also be capable of automatically shutting off if the apparatus 100 is not used within a predetermined time (e.g., 5 minutes). In these embodiments, the battery power in the batteries is saved if the user, who may be a child, forgets to turn off the interactive learning apparatus 100.

Interactive learning apparatus 100 also includes an input unit 108 disposed on the body 106. Input unit 108 includes a slidable knob. One skilled in the art, however, will recognize that input unit 108 can take other suitable forms, including but not limited to, a rotatable knob, a button, or a lever. Appropriate switches may be associated with the input unit 108 so that the user can inform the interactive learning apparatus 100 as to the particular mode of operation desired. In this example, the input unit 108 is configured to enable a user (e.g., a young child or a young child's parent) to turn interactive learning apparatus 100 on and off, and to select an operating mode.

Another input unit 150 is a button that is in the form of a star. In the illustrated embodiment, the apparatus is in the form of a drum. The button can allow a user to "scroll" through various drum sounds (or other types of sounds) such as snare, tom—tom, and steel drum sounds so that the user may select the sound desired After a user chooses a particular type of drum, the sound may be produced while the interactive active apparatus is in any of the modes described herein (e.g., the interactive song mode). In some embodiments, the apparatus may allow for the user to simply play with the drum as a drum, without any educational information being conveyed to the user while the user is using the apparatus.

The parts of the housing 102 can each be distinctively colored and molded with sculpted textural details that serve to engage the attention of a young child. For example, body 106 can be molded with a whimsical cartoon character such as a frog. Housing 102 also has a plurality of openings 110 to facilitate the provision of audio from an audio output unit located within housing 102.

Figure 3:
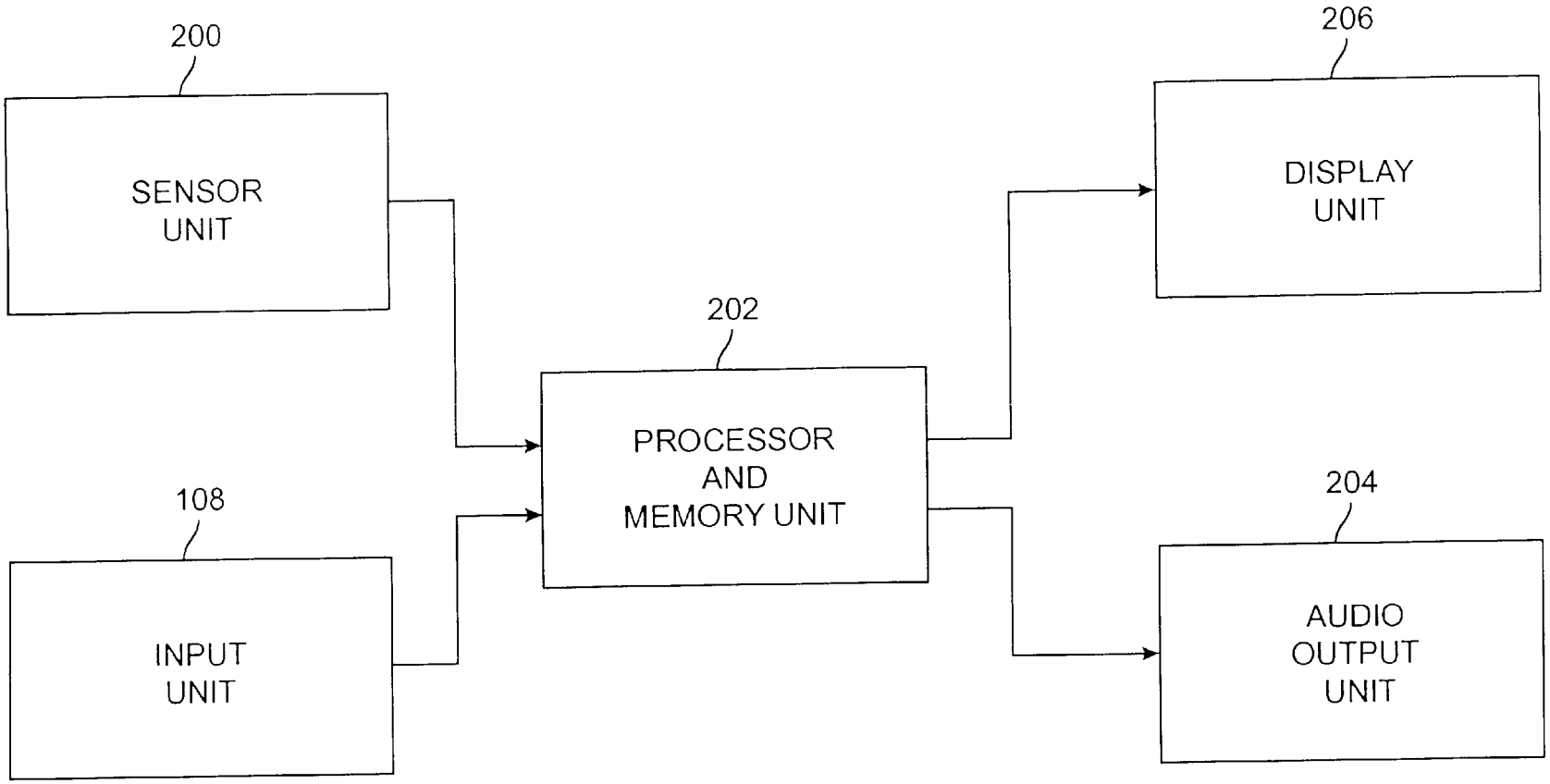
FIG. 3 is a block diagram of units employed in one exemplary embodiment of the present invention.
Figure 4A:
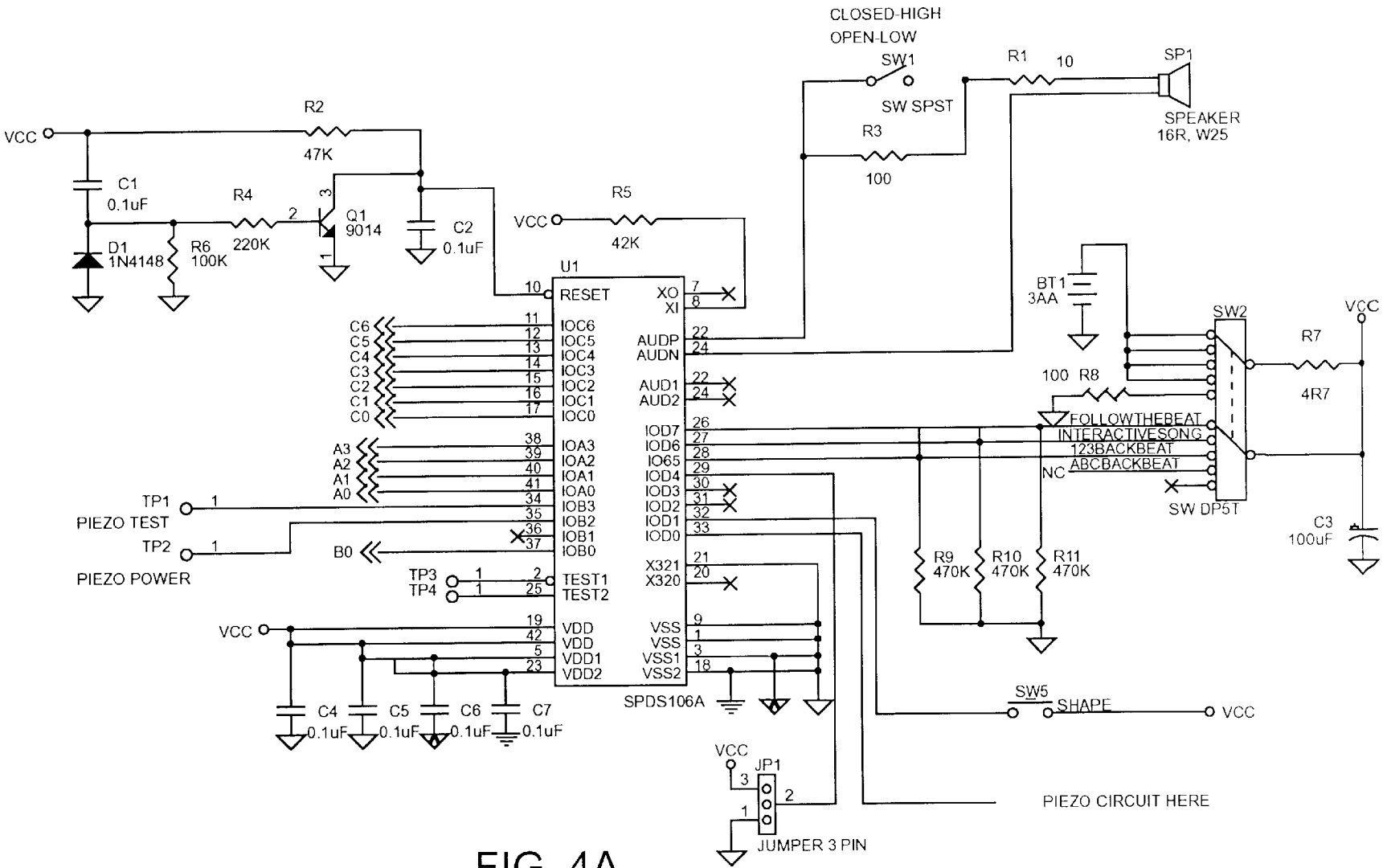
FIGS. 4A and 4B are electrical schematic diagrams of an exemplary circuit, 1 which can be used in embodiments of the invention.
Figure 4B:
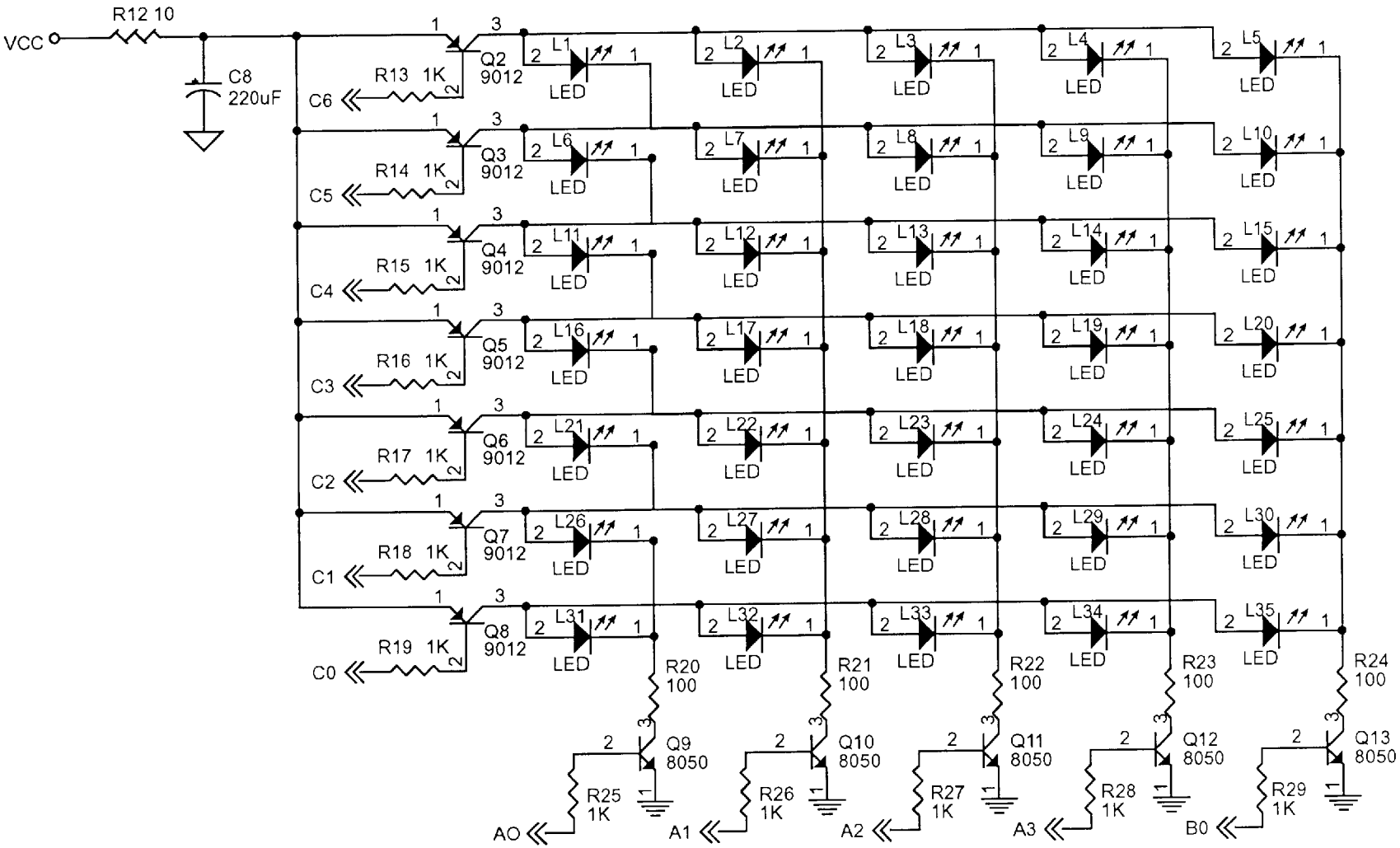

FIG. 3 shows a block diagram of some components of an interactive learning apparatus embodiment. The interactive learning apparatus 100 includes a sensor unit 200, a processor and memory unit 202, an audio output unit 204 and a display unit 206. Sensor unit 200 can be any impact sensor unit known to one skilled in the art as suitable for responding to the striking of upper portion 104. Such impact sensor units are commercially available and are well known to those of ordinary skill. For example, a piezo-electric sensor can be included in the impact sensor unit. In some embodiments of the invention, in order to activate the impact sensor unit 200, a child normally hits a portion of the housing with a greater amount of force than would be used to, for example, activate a button by pressing it. In these embodiments, slight pressing (e.g, without striking) may not activate the impact sensor unit 200. In other embodiments, the user may use less force to activate the impact sensor under the upper portion of the apparatus. Audio output unit 204 provides audio output (e.g., a musical background beat, a song or indicia identity) to a user of interactive learning apparatus 100 and can include a speaker and speech synthesizer. In other embodiments, the audio output unit 204 can include a speaker without a speech synthesizer.

Display unit 206 can be any suitable display unit that is capable of displaying a sequence of indicia (e.g., letters or numbers) on upper portion 104. Display unit 206 can be, for example, an array of light emitting diodes (LEDs). Selective LEDs within an array of LEDs can illuminate to display images on the upper portion 104 by projecting light thereon. In this regard, 35 LEDs has proven useful in projecting indicia such as letters, numbers, symbols, and shapes onto a 5.5 inch diameter circular upper surface. Specific LEDs within the array of LEDs can light up to form images for the user. Alternatively or additionally, in some modes, the LEDs can randomly illuminate to create a light show for the user. In these embodiments, the light show need not necessarily convey any particular type of information to the user.

Processor and memory unit 202 is operatively connected to sensor unit 200, audio output unit 204 and display unit 206. Processor and memory unit 202 can be any processor and memory unit known to one skilled in the art as suitable for facilitating operation of interactive learning apparatus 100. For example, processor and memory unit 202 can include a combination of a microprocessor (e.g., an application specific integrated circuit (ASIC) microprocessor) and a random access memory (RAM), read only memory (ROM) or erasable programmable memory (EPROM) integrated circuit. In the particular embodiment illustrated in FIG. 1, sensor unit 200, processor and memory unit 202, audio output unit 204 and display unit 206 are located within housing 102. The processor and memory unit 202 may be separate chips, such as a microprocessor chip and a memory chip that are spatially separated from each other. Alternatively, the processor and memory unit 202 may be housed in the same electronic package.

Processor and memory unit 202 can include a plurality of operating modes designed to teach different curricula in an engaging and entertaining manner. In one operating mode, referred to as "ABCs mode," the interactive learning apparatus audibly informs the child of the nature of learning in an encouraging manner with a phrase such as "Hi, let's play the drum! A, B, C, it's fun," when input unit 108 is employed to select the ABCs mode. Thereafter, the interactive learning apparatus displays and audibly identifies each of the 26 letters of the alphabet in sequence as upper portion 104 is struck. For example, when the young child first strikes the upper surface, "A" will be displayed on the upper surface and "A" will be audibly identified. When the child next strikes the upper surface, "B" will be displayed and audibly identified. This operating mode continues through the letter "Z."

In another operating mode, referred to as "123s mode," the interactive learning apparatus can audibly inform the child of the nature of learning in a friendly and encouraging manner with a phrase such as "Hi, let's count! 1, 2, 3," when input unit 108 is employed to select the 123s mode. Subsequently, the interactive learning apparatus displays and audibly identifies each of the numbers 1, 2, 3, 4, 5, 6, 7, 8, 9 and 10, in sequence, as upper portion 104 is struck many times. For example, when the child first strikes the upper surface, "1" will be displayed on the upper surface and audibly identified. In one exemplary embodiment, the apparatus can display a sequence of numbers that extends beyond ten (e.g., the sequence of numbers from one to twenty). However, the sequence of numbers from one to ten is especially appropriate for young children, who are have just begun learning numbers.

In some embodiments, when a sequence of indicia are sequentially displayed to the user, the interactive learning apparatus may have a timing mechanism that causes the apparatus to continue with the sequence if the user strikes the interactive apparatus within a predetermined period of time. For example, the interactive learning apparatus may be programmed to continue with the sequence A, B, C, if the user strikes the interactive learning apparatus within a window of 30 seconds. If the user strikes it after this period of time, the interactive learning apparatus may start the sequence from the beginning. In other modes, games can be played and/or quizzing can take place. For example, the apparatus may ask the user, "can you hit the drum three times"? Accordingly, some embodiments of the invention can provide interrogatory statements to engage the user. In yet other modes, songs such as "the ABCs song" can be played by the apparatus.

In some embodiments, when the interactive learning apparatus 100 is in use in either the ABCs or 123s mode, it can play a musical background beat. Such a musical background beat is user selectable from among musical background beats that simulate drumming sounds (e.g., a steel drum, a snare drum and a tom—tom drum). The use of such a musical background beat engages children's attention and encourages them to continue striking the upper surface of the interactive learning apparatus.

In yet another operating mode, referred to as the "follow-the-beat mode," interactive learning apparatus can be configured to teach young children musical awareness (i.e., musical patterns and the ability to follow musical patterns). The interactive learning apparatus accomplishes this by providing predetermined indicia display patterns on its upper surface, along with associated audible musical beat patterns, in a discontinuous manner that encourages pattern following. For example, the interactive learning apparatus can audibly inform the child of the nature of learning in an encouraging manner with a phrase such as "Let's play the drum, follow me, listen," when input unit 108 is employed to select the follow-the-beat mode. A predetermined indicia pattern is then displayed on the upper surface of the interactive learning apparatus, while an associated audible musical beat is played. The associated audible musical beat can optionally be synchronized to the predetermined indicia pattern.

The interactive learning apparatus then provides a "gap" in the displaying of the predetermined indicia pattern and associated audible musical beat. It is expected that the young child will imitate the associated audible musical beat during this gap. After a predetermined time period (e.g., a few seconds), the interactive learning apparatus will continue with the displaying of the predetermined indicia pattern and associated audible musical beat. If the young child did indeed imitate the musical beat by striking the upper surface, the interactive learning apparatus offers encouragement by announcing, for example, "You're great, good, alright, let's play again" before continuing.

In an additional operating mode, referred to as "Interactive Song mode," interactive learning apparatus can teach young children musical awareness. The interactive learning apparatus accomplishes this by playing music (e.g., an instrumental song or a song with phrases) in a discontinuous manner (e.g., with "gaps" of a predetermined time period) that encourages pattern following. It is expected that the young child will imitate the music by singing or striking the upper surface of the interactive learning apparatus during the gap. After a gap of a predetermined time period (e.g., a few seconds), the interactive learning apparatus will continue with the playing of the music. Unlike the "follow-the-beat mode," there is no predetermined indicia display patterns in the "Interactive Song mode." However, the "Interactive Song mode" can employ songs with lyrics, as well as instrumental songs. The "Interactive Song mode," therefore, teaches an aspect of musical awareness that compliments the patterns following taught by the "follow-the-beat mode."

FIGS. 3A and 3B are electrical schematic diagrams of an exemplary circuit which implements functions (e.g., operating modes) of the present invention. Those of ordinary skill in the art of electronic toys have knowledge, however, of a variety of microprocessors, logic circuits and other electronic components that can be utilized to implement the functions of the interactive learning apparatus embodiments.

The interactive learning apparatus embodiments can optionally include a slot (not shown) in the housing for a transferable information storage medium (not shown) in the housing. The slot can be cooperatively structured to receive the transferable storage medium in a removable manner. Any suitable transferable storage medium can be employed in the interactive learning apparatus including but not limited to, a data cartridge (e.g., a flash memory cartridge), a disk, a tape or a memory stick. The transferable information storage medium can be used to provide code for new operating modes, code for new visual images, or code for new audio (e.g., new songs or a new sequence of indicia) to the interactive learning apparatus.

The interactive learning apparatus can also be a part of a system that includes a linker device for transferring data (e.g., code for new audio, code for new images, or code for new operating modes) between the interactive learning apparatus and a computer (e.g., an Internet-enabled personal computer or server computer). The linker device can be any suitable linker device known to one skilled in the art, such as a wireless transceiver (e.g., a radio frequency (RF) transceiver or an infra-red (IR) transceiver) or a data port (e.g., a Universal Serial Bus (USB) data port). Such a data port enables a user to transfer data to, and from, the interactive learning apparatus through a physical connection (e.g., a data cable) between the interactive learning apparatus and, for example, a client computer. The inclusion of a linker device results on an Internet-enabled interactive learning apparatus. A further description of such systems is described in U.S. patent application Ser. No. 09/632,424, which is assigned to the same assignee as the present invention and which is herein incorporated by reference for all purposes.

It should be understood that various alternatives to the embodiments of the invention described herein may be employed in practicing the invention. It is intended that the following claims define the scope of the invention and that structures and methods within the scope of these claims and their equivalents be covered thereby. Moreover, one or more features of one or more embodiments may be combined in any suitable manner and can still be within the scope of the present invention.

What is claimed is:

1. An interactive learning apparatus comprising;

(a) a housing;

(b) an impact sensor unit in the housing;

(c) a processor and memory unit operatively coupled to the impact sensor unit;

(d) a display unit operatively coupled to the processor and memory unit; and (e) an audio output unit operatively coupled to the processor and memory unit, wherein the display unit is adapted to display an image in response to the user striking a portion of the housing, wherein the interactive learning apparatus is in the form of a drum.

2. The interactive learning apparatus of claim 1, wherein the audio output unit is capable of providing audio output relating to the image in response to the user striking the portion of the housing.

3. The interactive learning apparatus of claim 2 wherein the display unit comprises an array of light emitting diodes that are disposed under a surface of the housing where diodes in the array selectively illuminate to form the image.

4. The interactive learning apparatus of claim 3 further comprising:

an input unit operatively coupled to the processor and memory unit, wherein the input unit can be used to select from among a plurality of operating modes.

5. The interactive learning apparatus of claim 2 wherein the audio output unit comprises a speech synthesizer and a speaker.

6. The interactive learning apparatus of claim 5 wherein the sensor unit includes a piezo-electric sensor.

7. The interactive learning apparatus of claim 2 wherein the sensor unit includes a piezo-electric sensor.

8. The interactive learning apparatus of claim 7 further comprising:

an input unit operatively coupled to the processor and memory unit, wherein the input unit can be used to select from among a plurality of operating modes.

9. The interactive lemming apparatus of claim 1, wherein the display unit is adapted to sequentially display each indicium within a sequence of indicia after the user strikes the portion of the housing multiple times.

10. The interactive learning apparatus of claim 1, wherein the display unit comprises an ray of light emitting diodes that are disposed under a surface of the housing where diodes in the array selectively illuminate to form the image.

11. The interactive learning apparatus of claim 1, wherein the housing includes a plastic body and a translucent or transparent upper portion, and wherein the display unit is under the upper portion and is at least partially visible through the upper portion.

12. The interactive learning apparatus of claim 1, wherein the processor and memory unit and the audio output unit are adapted to play a musical background beat when the interactive learning apparatus is in use.

13. The interactive learning apparatus of claim 1, wherein the image is a letter.

14. The interactive learning apparatus of claim 1, wherein the image is a number.

15. The interactive learning apparatus of claim 1, wherein the display unit is adapted to sequentially display each indiciuni within a sequence of indicia after the user strikes the portion of the housing multiple times, and wherein the sequence of indicia includes the numbers 1, 2, 3, 4, 5, 6, 7, 8, 9 and 10, or the letters A through Z.

16. The interactive learning apparatus of claim 1, wherein the display unit provides predetermined indicia display patterns on the housing and the audio output device provides associated audible musical beat patterns in a discontinuous manner that encourages the user to follow a beat pattern.

17. The interactive learning apparatus of claim 1, wherein the audio output unit provides music in a discontinuous manner that encourages imitation by the user.

18. The interactive learning apparatus of claim 1 further comprising:

an input unit operatively coupled to the processor and memory unit, wherein the input unit can be used to select from among a plurality of operating modes.

19. The interactive learning apparatus of claim 1, wherein the audio output unit includes a speech synthesizer and a speaker.

20. The interactive learning apparatus of claim 19 further comprising:

an input unit operatively coupled to the processor and memory unit, wherein the input unit can be used to select from among a plurality of operating modes.

21. The interactive learning apparatus of claim 1, wherein the sensor unit includes a piezo-electric sensor.

22. The interactive learning apparatus of claim 1, wherein the interactive learning appliance is an educational toy.

23. The interactive learning apparatus of claim 1 further comprising:

a slot in the housing; and a transferable information storage medium removably inserted in the slot.

24. The interactive learning apparatus of claim 1, wherein the image is displayed where the user strikes the interactive learning apparatus.

25. An interactive learning apparatus comprising:

(a) a housing:

(b) an impact sensor unit in the housing:

(c) a processor and memory unit operatively coupled to the impact sensor unit;

(d) a display unit operatively coupled to the processor and memory unit; and (e) an audio output unit operatively coupled to the processor and memory unit, wherein the display unit is adapted to display an image in response to the user striking a portion of the housing, and an input unit operatively coupled to the processor and memory unit, wherein the input unit can be used to select from among a plurality of operating modes, wherein the plurality of operating modes include:

a first mode wherein the processor and memory unit, the display unit and the audio output unit are configured such that each one of a sequence of indicia is sequentially displayed on the housing in response to striking thereof and such that each one of the sequence of indicia being displayed is audibly identified in response to the striking of the housing;

a second mode wherein the display unit, the processor and memory unit and the audio output unit are configured to provide predetermined indicia display patterns on the housing and associated audible musical beat patterns in a discontinuous manner that encourages pattern following; and a third mode wherein the display unit, the processor and memory unit and the audio output unit are configured to play music in a discontinuous manner that encourages imitation, and wherein the input unit is configured for the user to select an operating mode.

26. An interactive learning apparatus comprising:

(a) a housing, wherein the housing includes a translucent upper portion and a body;

(b) an impact sensor unit in the housing;

(c) a processor and memory unit operatively coupled to the impact sensor unit;

(d) a display unit operatively coupled to the processor and memory unit and disposed under the translucent upper portion; and (e) an audio output unit operatively coupled to the processor and memory unit, wherein the display unit displays an image of a letter or an image of an indicium through the upper portion in response to the user striking the translucent upper portion of the housing and wherein the audio output unit is adapted to provide audio information relating to the displayed indicium to the user, and wherein the interactive learning apparatus is in the form of a drum.

27. The interactive learning apparatus of claim 26, wherein the housing further comprises a rim that secures the upper portion to the body.

28. The interactive learning apparatus of claim 26, wherein the indicium is an alphanumeric indicium.

* * * * *